United States Patent [19]

Hardwick

[11] 4,298,922

[45] Nov. 3, 1981

[54] ROTATABLY ADJUSTABLE TROUBLE LAMP SHIELD

[76] Inventor: Cret E. Hardwick, 2420 "B" St., Box 922, Baker, Oreg. 97814

[21] Appl. No.: 90,586

[22] Filed: Nov. 2, 1979

[51] Int. Cl.[3] ..... F21V 15/00

[52] U.S. Cl. ..... 362/376; 362/396; 362/427

[58] Field of Search ..... 362/376, 396, 427

[56] References Cited

U.S. PATENT DOCUMENTS 3,808,420 4/1974 Gortner ..... 362/396

4,019,047 4/1977 Frey ..... 362/396 X

*Primary Examiner*—Stephen J. Lechert, Jr.

*Attorney, Agent, or Firm*—Irons and Sears

[57] ABSTRACT

A rotatably adjustable light shield for shielding and suspending a portable trouble lamp is disclosed herein. The light shield generally comprises a cylindrical shield member, a mounting means attached to the bottom end of the shield member for mounting the shield member onto a trouble lamp, and a rotatably adjustable suspension means mounted on top of the shield member for providing a rotatably adjustable suspension mount for the shield. The suspension mount includes a plate having a circular array of detent cavities, a detent ball retainer rotatably mounted over the plate and having at least one detent ball receivable into each of the detent cavities in the plate, and a suspension hook assembly mounted onto the detent ball retainer for suspending the trouble lamp. The detent ball in the detent ball retainer serves both to retain the light beam in any of the angular positions associated with the circular array of detent cavities, and to transmit a tactile indication of the amount of rotary adjustment made when the handle of the trouble lamp connected to the shield is manually rotated relative to the suspension mount.

12 Claims, 6 Drawing Figures

FIG. 1
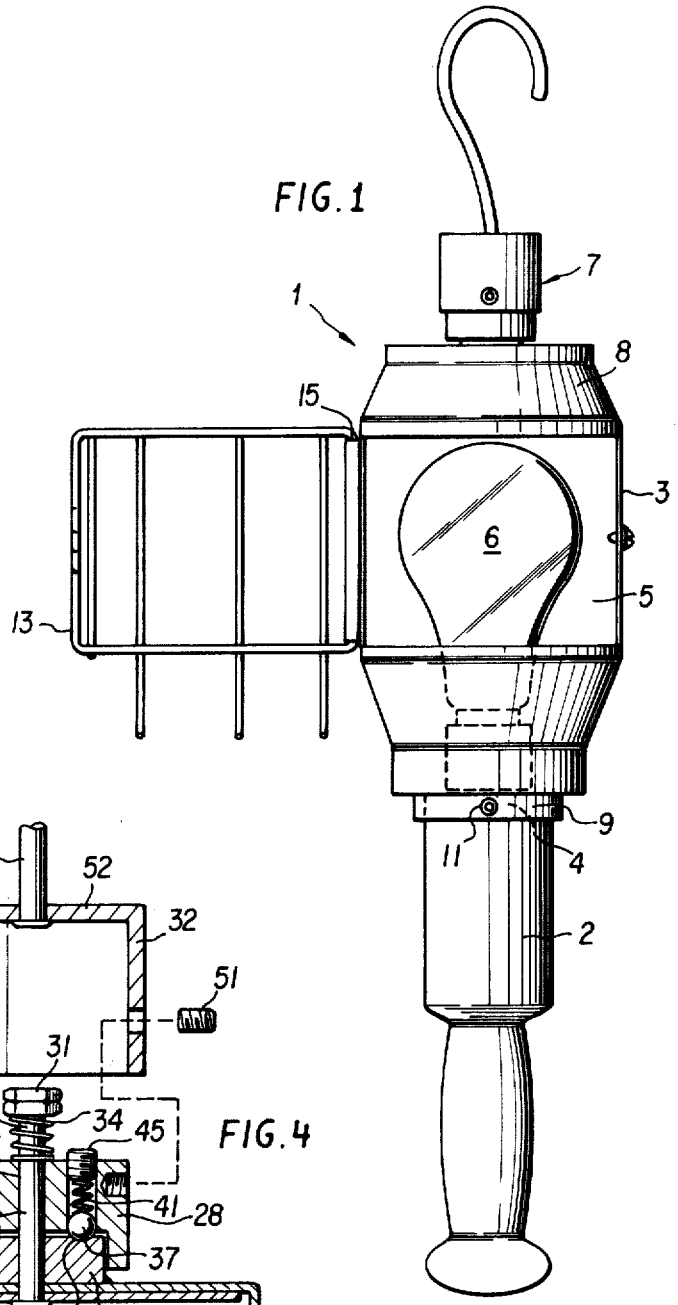
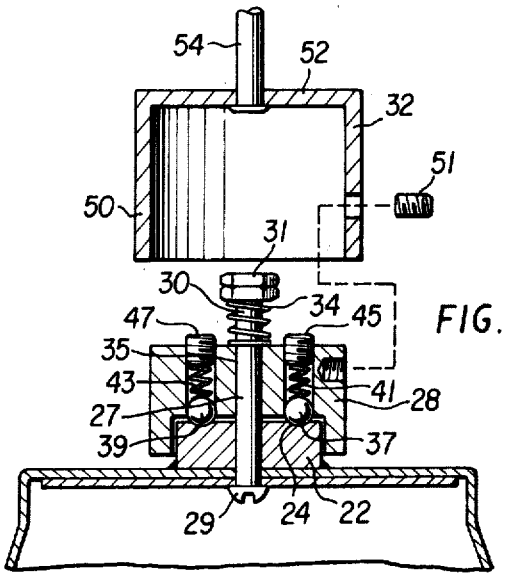
FIG. 4
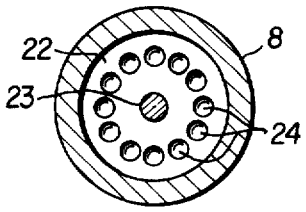
FIG. 5

ROTATABLY ADJUSTABLE TROUBLE LAMP SHIELD

BACKGROUND OF THE INVENTION

This invention relates to rotatably adjustable light shields for shielding and suspending portable trouble lamps.

Portable trouble lamps are extensively used to illuminate areas which are difficult to light by stationery light fixtures, such as gasoline engines located under the hoods of automobiles. Such trouble lamps frequently include a lamp shield for concentrating the rays of the lamp along a particular direction, as well as a suspension means, such as a hook, for suspending the lamp in the vicinity of the area to be illuminated.

Ideally, such a light shield should include a suspension means which is rotatably adjustable so that the light beam transmitted through the shield can be easily and conveniently directed toward a desired area. Further, whenever the handle of the trouble lamp is turned to rotatably adjust the beam of light, the user should not have to wait for the lamp to swing back into an equilibrium position before knowing the amount of angular adjustment he has made on the light beam. Rather, the suspension mount should be capable of immediately indicating to the user the exact amount of angular adjustment made on the direction of the light beam at the time the handle of the trouble lamp is turned. Furthermore, the rotatably adjustable suspension mount should have some sort of means for adjusting the amount of torque necessary to adjust the position of the light beam to a desired angle. Moreover, the light shield should serve not only to direct the light emitted from the light bulb of the lamp into a concentrated beam, but should also serve to protect the fragile light bulb disposed therein from all manner of mechanical shocks. Finally, the light shield should be easily and conveniently mountable onto a variety of trouble lamps.

Rotatably adjustable light shields for portable trouble lamps are known in the prior art. Examples of such light shields are disclosed in U.S. Pat. Nos. 2,569,068, 2,602,880, 2,694,776, 2,707,229, 3,808,420, 3,828,181, and 4,019,047.

However, each of these prior art light shields falls short fulfilling at least one of the above mentioned ideal criteria. For example, the rotatably adjustable suspension mount disclosed in U.S. Pat. No. 4,019,047 makes no provision for adjusting the amount of torque which must be applied between the suspension hook and the body of the shield member before angle of the light beam may be changed. Furthermore, there is no provision for providing a signal to the user as to the amount of angular adjustment made when the suspension mounting of this invention is used. Finally, the shield member of this invention does not protect the top of the fragile light bulb disposed therein.

Similarly, the rotatably adjustable trouble light shields disclosed in U.S. Pat. Nos. 3,828,181, 3,808,820, and 2,707,229 also have no provision for adjusting the amount of torque which must be applied between the suspension mount and the body of the shield member before the angle of the light beam may be adjusted. Furthermore, the rotatably adjustable suspension means in U.S. Pat. No. 2,707,229 must be inconveniently depressed toward the body of the light shield member before an angular adjustment may be made. Likewise inconvenient is the suspension arrangement disclosed in U.S. Pat. No. 3,808,420, which must be pulled away from the body of the light shield member before an angular adjustment may be made.

Finally, none of the suspension means for the light shields disclosed in U.S. Pat. Nos. 2,569,068, 2,694,776 or 2,602,880 provides any sort of signal to the user as to the amount of angular adjustment made on the light beam when the handle of the trouble lamp is grasped and turned by the user. Rather, in each of these units, the user must grasp the handled trouble lamp, turn it to place the beam in the desired location, and then release the handle of the lamp and hope that the light beam will still be focused on the desired area after the lamp sways back and forth a couple of times from its suspension mount in seeking a new stable rest position. Additionally, the light shields disclosed in U.S. Pat. Nos. 2,602,880 and 2,694,776 leave the top portion of the delicate electric light bulb exposed to mechanical shock, and thus do not effectively shield the light bulbs within their respective shield assemblies.

SUMMARY OF THE INVENTION

The invention encompasses a light shield for a trouble lamp which may be rotatably adjusted without any of the shortcomings associated with the previously discussed prior art.

Basically, the invention comprises a cylindrical shield member having an aperture on one side for the transmission of light therethrough, a mounting means attached to the bottom end of the shield member for mounting it onto the light bearing end of a trouble lamp, and a rotatably adjustable suspension means mounted onto the top end for suspending the light shield. The rotatably adjustable suspension means of the invention includes a plate having a circular array of regularly spaced detent cavities which is mounted onto the top end of the light shield, a detent ball retainer which is rotatably mounted over the plate and which has at least one detent ball receivable into each of the detent ball cavities, and a suspension hook assembly mounted onto the detent ball retainer for suspending the light shield.

The detent ball retainer serves not only to retain the light shield member in any one of the angular positions corresponding to the detent cavities in the cavity plate, but also serves to transmit a tactile indication of the amount of rotary adjustment made when the handle of the trouble lamp connected to the shield is manually rotated relative to the suspension mount. Additionally, the rotatably adjustable suspension mount of the invention may include a means for adjusting the frictional resistance between the detent ball retainer and the plate so that the user may adjust the amount of torque he must apply to the handle of the trouble lamp before an angular light beam adjustment is made.

Moreover, the suspension hook of the assembly may include a double hook to stabilize the position of the suspended lamp and to help prevent the suspended lamp from undue swinging and swaying after an angular adjustment is made.

Further, the light shield of the invention substantially surrounds all portions of the fragile electric bulb disposed therein, thereby shielding the light bulb from mechanical shock to a greater degree than most prior art light shields. The light shield of the invention may further include a cage door member pivotably swingable over the light transmitting aperture in the shield member, which affords even more protection for mechanical shock to the light bulb disposed therein. Additionally, the light shield of the invention may also include a spotlight attachment which is attachable over the cage door member of the shield and which serves to concentrate the light beam transmitted from the lamp into a smaller, more intense beam. Finally, the light shield of the invention may include a split ring mounting means on its bottom end for conveniently mounting the shield onto a variety of prior art trouble lamp handles.

BRIEF DESCRIPTION OF THE SEVERAL DRAWINGS

FIG. 1 illustrates a front view of the preferred embodiment of the invention with the pivotably mounted cage door open;

FIG. 4 illustrates a cross-sectional view of the rotatably adjustable suspension means of the invention;

FIG. 5 illustrates a top view of the plate member of the rotatably adjustable suspension means of the invention.

DETAILED DESCRIPTION OF THE PREFERRED EMBODIMENT

Figure 2:
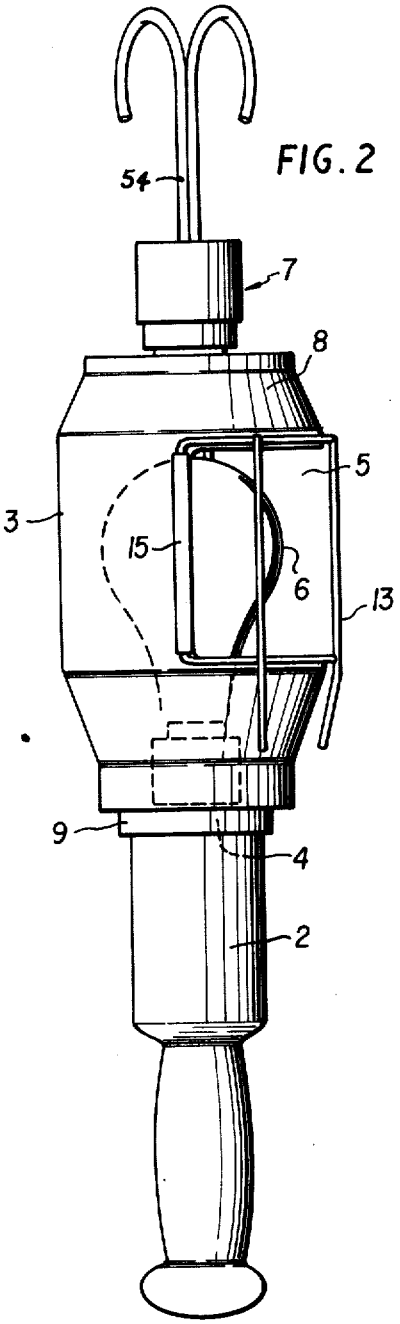
FIG. 2 illustrates a side view of the preferred embodiment with the cage door closed.

With reference now to FIGS. 1 and 2, the rotatably adjustable light shield of the invention 1 generally comprises a shield member 3, a split ring mounting means 9 on the bottom end of shield member for mounting the shield member 3 onto the light bearing end 9 of a trouble lamp handle 2, and a rotatably adjustable suspension means 7 on the top end of the shield member 5 for providing a rotatably adjustable suspension means for the shield member 3.

Shield member 3 includes an aperture 5 for transmitting light from the electric light bulb 6 disposed therein. Preferably, shield member 3 completely encloses the bulb 6 at all other points so as to afford maximum protection to the bulb 6 from mechanical shocks and moisture. A cage door 13 pivotably mounted on shield member 3 by pivotable mounting means 15 swings over aperture 5 to protect the bulb 6 from mechanical shocks applied in the vicinity of the aperture 5. The top of shield member 3 includes an upper section 8 which completely covers the top of light bulb 6, and provides a mounting surface for mounting the rotatably adjustable suspension means 7 of the invention. The bottom portion of shield member 3 includes a split ring mounting means 9 for mounting the shield member onto the upper portion 4 of the trouble lamp handle 2.

Figure 3:
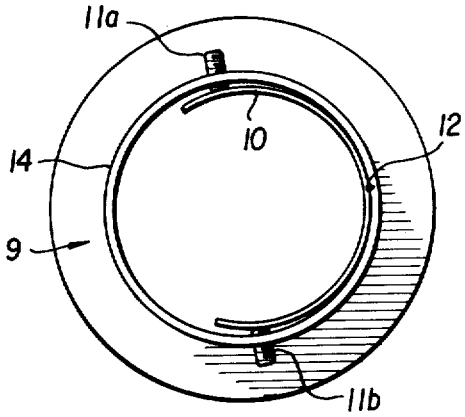
FIG. 3 illustrates the split ring mounting means of the preferred embodiment.

With reference now to FIG. 3, the split ring mounting means 9 of the invention includes a shield member collar 14 having a split ring member 10 spot weld or otherwise secured at point 12 on its inner periphery. Split ring mounting means 9 further includes a pair of clamping screws 11*a, b* for tightening the split ring member 10 around a portion 4 of the light bearing end of a trouble lamp handle 2. Split ring mounting means 9 allows the rotatably adjustable light shield 1 of the invention to be mounted onto a variety of trouble lamp handles in both a secure and an aesthetic manner, as the actual split ring clamping member 10 is concealed within collar 14 when the shield is mounted onto a trouble lamp handle 2.

With reference now to FIGS. 4 and 5, the rotatably adjustable mounting means 20 of the invention generally comprises a plate 22, a detent ball retainer 28, and a suspension hook assembly 32 assembled together as shown.

Plate 22 is securely mounted onto the top portion 8 of light shield member 3 and includes a circular array of regularly spaced detent cavities 24. Since the angular distance between these cavities 24 determines the minimum angular beam adjustment which can be made with the invention 1, it is desirable that plate 22 contain at least twelve such cavities, as shown, although the invention may include a greater or lesser number of such cavities. Plate 22 is preferably one and three-eighths inches in diameter.

Detent ball retainer 28 is rotatably mounted over plate 22 by means of a bolt 27 having a head 29 and a threaded end 30. Bolt 27 is received through an aperture in the bottom of top portion 8 of shield member 3 and through bores 23 and 35 present in plate member 22 and detent ball retainer 28, respectively. Screw 27 is retained in place through bores 23 and 35 by means of lock nuts 31 threadedly engaged onto the threaded end 30 of the screw. A coil spring 34 heliocentrically disposed around threaded end 30 of bolt 27 between lock nuts 31 and the top surface of detent ball retainer 28 controls the amount of frictional engagement between detent ball retainer 28 and plate 22.

Detent ball retainer 28 includes a pair of detent balls 37, 39 which are receivable into each of the detent cavities 24 of plate 22 when plate 22 is rotated relative to the detent ball retainer 28. Each of these balls 37, 39 is mounted in a detent ball bore as illustrated in FIG. 4. Further, each of these balls 37, 39 is spring loaded by means of coil springs 41, 43 which are adjustably compressible by means of set screws 45, 47. Thus, the friction between detent ball retainer 28 and plate 22 may also be adjusted by increasing or decreasing the spring pressure against detent balls 37, 39 by means of set screws 45 and 47, as well as by raising or lowering lock nuts 31 along the threaded end 30 of screw 27. Detent ball retainer 28 is preferably one and one-half inches in diameter.

The suspension assembly 32 of the invention 1 includes an annular skirt 50 for receiving detent ball retainer 28. Skirt 50 is secured onto detent ball member 28 by means of a set screw 51. Annular skirt 50 terminates in a closed top 52 onto which a double hook 54 is preferably mounted in the position shown in FIGS. 2 and 4. The use of double hook 54 helps both to stabilize the position of the suspended lamp, and to prevent the suspended lamp from undue swinging and swaying after an annular adjustment is made. The two hooks comprising the double hook 54 are angularly spread apart from each other approximately 35°.

The use of a single set screw 51 to mount skirt 50 onto detent ball retainer 28 facilitates quick and conventional removal of suspension hook assembly 32 from retainer 28, thereby rendering easy access to the lock nuts 31 and detent ball retaining screws 45 and 47 when frictional adjustments between plate 22 and detent ball retainer 28 are desired. Skirt 50 preferably has an outer diameter of one and five-eighths inches.

Figure 6:
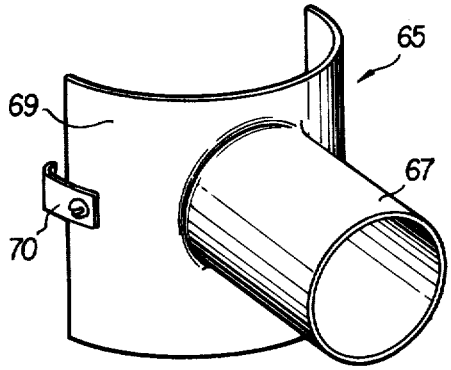
FIG. 6 illustrates a perspective view of the spotlight attachment of the invention.

With reference to FIG. 6, the invention 1 also encompasses a spotlight attachment 65. Spotlight attachment 65 includes a cylindrical light collimator 67 mounted onto an arcuate member 69 which conforms to the curve of the substantially cylindrically shaped shield member 3 and completely covers the light transmitting aperture 5 contained therein. The spotlight attachment 65 may be mounted onto shield member 3 over cage door 13 by snapping bracket 70 over the pivotal mounting means 15, and snapping another bracket (not shown) located on the other side of the attachment 65 over cage door mounting screw 16.

In operation, the rotatably adjustable light shield of the invention 1 is first mounted onto the light bearing end 4 of the handle 2 of a conventional trouble lamp. The light is then suspended close to the area to be illuminated by means of the suspension hook assembly 32 of the rotatably adjustable suspension means 7 of the invention. Finally, the light transmitted out of aperture 5 of shield member 3 is directed onto the specific area desired to be illuminated by manually twisting the trouble lamp handle 2 while the trouble lamp is suspended by the suspension hook assembly 32. Each "click" that the user feels from the rotatably adjustable suspension means 7 through the handle 2 of the lamp indicates to him that the beam of light transmitted through aperture 5 will be angularly changed by 30° when the handle 2 is released and the trouble lamp swings back into a stable position.

Having described my invention in such full, concise and complete terms so as to enable any person of ordinary skill in the art to make and use the same, I claim:

1. A rotatably adjustable light shield for shielding and suspending a portable trouble lamp of the type having an elongated handle with an electric light mounted on one end, comprising:

(a) a shield member for substantially enclosing said electric light of said lamp, said shield member having a top end and a bottom end and an aperture on one side for the transmission of light therethrough;

(b) a mounting means attached to the bottom end of said shield member for mounting said shield member onto said light bearing end of said trouble light handle;

(c) a rotatably adjustable suspension means mounted onto the top end of said shield member for providing a rotatably adjustable suspension mount for said shield member, including:

(i) a plate having a circular array of regularly spaced detent cavities mounted onto the top end of said light shield;

(ii) a detent ball retainer rotatably mounted over said plate and having at least one detent ball receivable into each of said detent cavities for retaining said light shield in any of the angular positions associated with each of said detent cavities and for transmitting a tactile indication of the amount of rotary adjustment made when said light shield is mounted onto a trouble lamp and said handle of said trouble lamp is manually rotated relative to said suspension means, and (iii) a suspension hook assembly mounted onto said detent ball retainer for suspending said trouble lamp.

2. The rotatably adjustable light shield of claim 1 wherein said top end of said shield member completely covers the top of said electric light of said trouble lamp when said shield is mounted onto said lamp.

3. The rotatably adjustable light shield of claim 2 wherein said shield member further includes a cage door member pivotably swingable over said shield member aperture.

4. The rotatably adjustable light shield of claim 2 further including a spotlight attachment mountable over said shield member aperture.

5. The rotatably adjustable light shield of claim 1 wherein the interior surface of said light shield member is coated with a reflective coating for concentrating the radiation emitted by said light bulb out of the shield member aperture.

6. The rotatably adjustable light shield of claim 1 wherein said light bearing end of said trouble lamp includes a neck, and said mounting means attached to the bottom end of said shield member includes a collar, a split ring disposed within and attached to said collar, and at least one set screw in said collar abutting said split ring for tightening said ring around said neck of said trouble lamp.

7. The rotatably adjustable light shield of claim 1 wherein said top end of said shield member, said plate and said detent ball retainer each include a bore, and said light shield further includes a bolt having a head and a threaded end received within said bores for rotatably mounting said detent ball retainer onto said plate.

8. The rotatably adjustable light shield of claim 7 further including a spring heliocentrically disposed around said threaded end of said bolt, and a pair of lock nuts threadedly engaged to said end of said bolt for adjusting the amount of frictional resistance between said detent ball retainer and said plate.

9. The rotatably adjustable light shield of claim 8 wherein said detent cavities in said plate are angularly spaced 30° apart.

10. The rotatably adjustable light shield of claim 9 wherein said detent ball retainer includes two spring loaded detent balls, each of said spring loaded detent balls being receivable into one of said detent cavities when said handle of said trouble lamp connected to said shield is manually rotated.

11. The rotatably adjustable light shield of claim 10 wherein said two spring loaded detent balls are linearly opposed to one another relative to said bore in said plate.

12. The rotatably adjustable light shield of claim 11 wherein said suspension hook assembly includes a pair of hooks for stabilizing said lamp when said lamp is suspended.

* * * * *